US007458662B2

(12) United States Patent
Ishikawa

(10) Patent No.: US 7,458,662 B2
(45) Date of Patent: Dec. 2, 2008

(54) LIQUID DROPLET-JETTING HEAD, LIQUID DROPLET-JETTING APPARATUS, AND LIQUID DROPLET-JETTING METHOD

(75) Inventor: Hiroyuki Ishikawa, Nisshin (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 135 days.

(21) Appl. No.: 11/583,501

(22) Filed: Oct. 18, 2006

(65) Prior Publication Data

US 2007/0085867 A1 Apr. 19, 2007

(30) Foreign Application Priority Data

Oct. 18, 2005 (JP) ..... 2005-302834

(51) Int. Cl.
*B41J 2/045* (2006.01)

(52) U.S. Cl. ..... 347/70; 347/47; 347/44

(58) Field of Classification Search ..... 347/70, 347/44–47

See application file for complete search history.

(56) References Cited

U.S. PATENT DOCUMENTS 5,502,473 A * 3/1996 East et al. ..... 347/73
6,149,258 A 11/2000 Kimura
7,048,362 B2 5/2006 Takahashi
2003/0226906 A1* 12/2003 Ivri ..... 239/102.2

FOREIGN PATENT DOCUMENTS

JP 2785727 5/1998
JP 3125499 11/2000
JP 2004-160915 6/2004

* cited by examiner

*Primary Examiner*—Matthew Luu
*Assistant Examiner*—Brian J. Goldberg
(74) *Attorney, Agent, or Firm*—Reed Smith LLP

(57) ABSTRACT

In an ink-jet head having a plurality of nozzles for discharging liquid droplets, vibration is generated in a direction connecting two nozzles, of the nozzles, by the discharge operation performed at least one of the nozzles. In particular, when the printing frequency is in the vicinity of the secondary mode frequency (for example, 27.5 kHz) of the proper vibration of the ink-jet head, the crosstalk easily arises. The crosstalk is hardly caused when the ratio of the secondary mode frequency of the ink-jet head to the printing frequency is any one of a value of not more than 0.85, a value in a range of 1.25 to 1.96, and a value of not less than 4.59.

19 Claims, 8 Drawing Sheets

| PRINTING FREQUENCY [kHz] | JUDGMENT OF CROSSTALK | SECONDARY MODE FREQUENCY / PRINTING FREQUENCY |
|---|---|---|
| 4 | ++ | 6.875 |
| 6 | ++ | 4.583 |
| 8 | + | 3.438 |
| 10 | ± | 2.750 |
| 12 | ± | 2.292 |
| 14 | + | 1.964 |
| 16 | + | 1.719 |
| 18 | + | 1.528 |
| 20 | + | 1.375 |
| 22 | + | 1.250 |
| 24 | ± | 1.146 |
| 26 | − | 1.058 |
| 28 | − | 0.982 |
| 30 | ± | 0.917 |
| 32 | + | 0.859 |
| 34 | ++ | 0.809 |

Fig. 8

| PRINTING FREQUENCY [kHz] | JUDGMENT OF CROSSTALK | SECONDARY MODE FREQUENCY / PRINTING FREQUENCY |
|---|---|---|
| 4 | ++ | 6.875 |
| 6 | ++ | 4.583 |
| 8 | + | 3.438 |
| 10 | ± | 2.750 |
| 12 | ± | 2.292 |
| 14 | + | 1.964 |
| 16 | + | 1.719 |
| 18 | + | 1.528 |
| 20 | + | 1.375 |
| 22 | + | 1.250 |
| 24 | ± | 1.146 |
| 26 | − | 1.058 |
| 28 | − | 0.982 |
| 30 | ± | 0.917 |
| 32 | + | 0.859 |
| 34 | ++ | 0.809 |

LIQUID DROPLET-JETTING HEAD, LIQUID DROPLET-JETTING APPARATUS, AND LIQUID DROPLET-JETTING METHOD

CROSS REFERENCE TO RELATED APPLICATION

The present invention claims priority from Japanese Patent Application No. 2005-302834, filed on Oct. 18, 2005, the disclosure of which is incorporated herein by reference in its entirety.

BACKGROUND OF THE INVENTION

1. Field of the Invention

The present invention relates to a liquid droplet-jetting head, a liquid droplet-jetting apparatus, and a liquid droplet-jetting method for discharging or jetting a liquid onto an object.

2. Description of the Related Art

The liquid droplet-jetting head, which is used, for example, as an ink-jet head body of a printer, includes a liquid droplet-jetting head as described in U.S. Pat. No. 7,048,362 B2 (corresponding to Japanese Patent Application Laid-open No. 2004-160915). The head body described in U.S. Pat. No. 7,048,362 B2 has a plurality of nozzles for discharging or jetting the ink. The nozzles are formed on a lower surface of a flow passage unit (channel unit) which is installed in the head body. The printing paper is set under or below the head body. The printer performs printing, for example, of an image on the printing paper by discharging the ink from the nozzles formed in the head body while transporting the printing paper at a velocity corresponding to a predetermined printing cycle.

When the printing is performed by using the head body as described in U.S. Pat. No. 7,048,362 B2, the following problem arises in relation to the ink discharge in some cases due to the vibration of the flow passage unit.

When the ink is discharged from one nozzle formed on the head body, the flow passage unit is vibrated due to the reaction caused thereby. The vibration affects the next ink discharge to be performed by the nozzle in some cases. In other cases, the vibration is propagated or transmitted from one nozzle to another nozzle, and the vibration affects the ink discharge operation to be performed by the another nozzle. The phenomenon, in which the ink discharge operation performed by one nozzle affects the ink discharge performed by the same nozzle or another nozzle, is called "crosstalk". When the crosstalk arises, then the ink discharge characteristics are varied, and any unnecessary difference in density or the like sometimes appears on a printed image.

SUMMARY OF THE INVENTION

An object of the present invention is to provide a liquid droplet-jetting head, a liquid droplet-jetting apparatus, and a liquid droplet-jetting method in which the crosstalk is hardly caused, and the discharge characteristics of the liquid such as the ink are hardly varied.

According to a first aspect of the present invention, there is provided a liquid droplet-jetting head which jets liquid droplets at a predetermined resolution while moving relative to an object, the liquid droplet-jetting head including a flow passage unit which has a plurality of nozzles for discharging the liquid droplets and a nozzle surface in which the nozzles are formed; wherein a ratio of a secondary mode frequency of inter-nozzle proper vibration in relation to an inter-nozzle direction along a line connecting a nozzle of the nozzles and another nozzle in the nozzle surface, to a jetting frequency which is a reciprocal of time required for the object to move relative to the liquid droplet-jetting head by a unit distance corresponding to the predetermined resolution, is one of a value of not more than 0.85, a value in a range of 1.25 to 1.96, and a value of not less than 3.44.

When the ink-jet head is vibrated at a predetermined frequency, the nozzle surface of the ink-jet head is greatly vibrated (resonated) in the inter-nozzle direction. In the present invention, the frequency, which is obtained in this situation, is called "natural frequency of the inter-nozzle proper vibration (inter-nozzle proper oscillation, inter-nozzle natural frequency)". As described later on, the "inter-nozzle natural frequency" is classified, for example, into the primary mode (inter-nozzle natural) frequency and the secondary mode (inter-nozzle natural) frequency depending on the vibration mode of the generated resonance. When the nozzle surface is vibrated in the secondary mode, the difference arises in the liquid droplet discharge characteristics between a nozzle which is displaced in one direction perpendicular to the nozzle surface from the equilibrium position and another nozzle which is displaced in the other direction different from the one direction. When the printing is performed at a printing frequency which is close to each of those in the modes of the natural frequency of the inter-nozzle proper vibration, the resonance tends to appear. On the other hand, according to the present invention, the resonance is suppressed, because the inter-nozzle natural frequencies in the primary mode and the secondary mode are far different from the printing frequency. Therefore, the difference in the liquid droplet discharge characteristics as described above are hardly caused.

In the liquid droplet-jetting head of the present invention, the ratio may be 1.25 to 1.96. In this case, the secondary mode inter-nozzle natural frequency is greater than the jetting frequency. Further, the primary mode inter-nozzle natural frequency is set to be smaller than the jetting frequency. Therefore, the resonance is hardly caused in the secondary or higher order modes, and the primary mode resonance is suppressed as well. Further, the flow passage unit can be realized with ease as compared with a flow passage unit in which the secondary mode frequency is greater than 1.96 times the jetting frequency.

In the liquid droplet-jetting head of the present invention, the jetting frequency may be not more than 30 kHz. In this case, the jetting frequency is suppressed. Therefore, when the inter-nozzle natural frequency in the nth-order mode (n represents a natural number) is greater than 30 kHz, the resonance is suppressed in the nth-order mode or higher modes. Therefore, the resonance is suppressed with ease as compared with a case in which the jetting frequency is higher than 30 kHz.

In the liquid droplet-jetting head of the present invention, the flow passage unit may have a nozzle row which is formed by the nozzles aligned on a line in the nozzle surface. In this case, when the nozzles, which belong to one nozzle row, simultaneously discharge the liquid droplets, the nozzle surface is resonated in many cases. According to the present invention, the resonance is suppressed even in such a situation, and the difference hardly appears in the discharge characteristics among the nozzles.

In the liquid droplet-jetting head of the present invention, the flow passage unit may have a plurality of nozzle rows which are arranged in parallel to each other; each of the nozzle rows may include the nozzles aligned on a line in the nozzle surface; and the inter-nozzle direction may be a direction along a line connecting a nozzle of the nozzles belonging to a nozzle row of the nozzle rows and another nozzle belonging to another nozzle row which is different from the nozzle row. Also in this case, the resonance is suppressed, and the difference hardly appears in the liquid droplet discharge characteristics among the nozzle rows.

In the liquid droplet-jetting head of the present invention, the flow passage unit may be flat plate-shaped, and the flow passage unit may be formed with a plurality of pressure chambers, a liquid chamber commonly communicated with the plurality of pressure chambers, and a plurality of flow passages each communicating the liquid chamber with one of the pressure chambers and one of the nozzles. Further, the liquid droplet-jetting head of the present invention may further include an actuator which applies a pressure to the plurality of pressure chambers, wherein the actuator may be stacked on a surface of the flow passage unit on a side opposite to the nozzle surface. In these cases, only the liquid stored in a desired pressure chamber can be selectively jetted.

In the liquid droplet-jetting head of the present invention, the actuator may apply an external force to the flow passage unit. In this case, for example, it is possible to utilize an actuator such as a piezoelectric actuator which causes the deformation in the flow passage unit by applying the force from the outside.

In the liquid droplet-jetting head of the present invention, the liquid chamber may include a plurality of common liquid chambers, and each of the common liquid chambers may extend in a direction which is parallel to the nozzle surface and which is perpendicular to the inter-nozzle direction. When the plurality of common liquid chambers, which extend in the direction parallel to the nozzle surface and perpendicular to the inter-nozzle direction, are formed in the flow passage unit, the resonance is generated in many cases, which causes the vibration greatly in the inter-nozzle direction. According to the present invention, the resonance is suppressed even in such a situation, and the difference hardly appears in the discharge characteristics among the nozzles.

The liquid droplet-jetting head of the present invention may further include a support member which extends in the inter-nozzle direction, wherein the support member may be joined to the flow passage unit. In this case, the flow passage unit is supported by the support member in the inter-nozzle direction. Therefore, the frequency of the inter-nozzle proper vibration is increased. Accordingly, when the difference is increased between the printing frequency and the frequency of the inter-nozzle proper vibration in the respective modes, the resonance is suppressed.

In the liquid droplet-jetting head of the present invention, a portion of the flow passage unit joined to the support member and the support member may be formed of a metal material; and the flow passage unit and the support member may be joined to each other with a brazing filler metal. In this case, the flow passage unit is strongly supported by the support member by the aid of the brazing filler metal. Therefore, when the difference is increased between the printing frequency and the inter-nozzle natural frequency in the respective modes, the resonance is suppressed.

In the liquid droplet-jetting head of the present invention, the flow passage unit may include a metal member which extends in the inter-nozzle direction. In this case, the inter-nozzle natural frequency is increased as compared with a case in which the flow passage unit is formed of only a member having a hardness lower than that of the metal. Accordingly, when the difference is increased between the printing frequency and the inter-nozzle natural frequency in the respective modes, the inter-nozzle natural frequency is suppressed.

In the liquid droplet-jetting head of the present invention, the nozzle surface may be formed on the metal member. In this case, the inter-nozzle natural frequency is increased. Accordingly, when the difference is increased between the printing frequency and the frequency in the respective modes, the resonance is suppressed.

The liquid droplet-jetting head of the present invention may further include an adjusting member which adjusts the ratio. In this case, the resonance can be suppressed, because the inter-nozzle natural frequency can be adjusted, for example, by the shape and the material of the adjusting member.

According to a second aspect of the present invention, there is provided a liquid-jetting apparatus which jets a liquid to an object, the liquid-jetting apparatus including: a moving mechanism which moves the object in a predetermined direction; and a head which jets the liquid at a predetermined resolution while moving relative to the object, the head including a flow passage unit which has a plurality of nozzles for discharging liquid-droplets of the liquid, a plurality of pressure chambers communicating with the nozzles, respectively, and a nozzle surface having the nozzles formed therein; and an actuator unit which is formed in the flow passage unit on a side opposite to the nozzle surface so as to face the pressure chambers, and which applies a pressure to the pressure chambers; wherein a ratio of a secondary mode frequency of inter-nozzle proper vibration in relation to an inter-nozzle direction along a line connecting a nozzle of the nozzles and another nozzle in the nozzle surface, to a frequency which is a reciprocal of time required for the object to move relative to the head by a unit distance corresponding to the predetermined resolution, is one of a value of not more than 0.85, a value in a range of 1.25 to 1.96, and a value of not less than 3.44.

According to the second aspect of the present invention, the resonance is suppressed, because the inter-nozzle natural frequencies in the primary and secondary modes are separated from the printing frequency.

The liquid-jetting apparatus of the present invention may be an ink-jet printer. In this case, the ink-jet printer is provided, in which the crosstalk is suppressed.

In the liquid-jetting apparatus of the present invention, the head may further include an adjusting member which adjusts the ratio, wherein the adjusting member may be a support member which extends in the inter-nozzle direction, and the support member and the flow passage unit may be joined to each other. In the case as described above, the resonance can be suppressed, because the inter-nozzle natural frequency can be adjusted, for example, by the shape and the material of the adjusting member.

According to a third aspect of the present invention, there is provided a liquid droplet-jetting method for jetting liquid droplets by using a liquid droplet-jetting head which jets the liquid droplets at a predetermined resolution while moving relative to an object, the liquid droplet-jetting method including: preparing the liquid droplet-jetting head provided with a flow passage unit which has a plurality of nozzles for discharging the liquid droplets and a nozzle surface in which the nozzles are formed; and determining a jetting frequency so that a ratio of a secondary mode frequency of inter-nozzle proper vibration in relation to an inter-nozzle direction along a line connecting a nozzle of the nozzles and another nozzle in the nozzle surface, to the jetting frequency which is a reciprocal of time required for the object to move relative to the liquid droplet-jetting head by a unit distance corresponding to the predetermined resolution, is one of a value of not more than 0.85, a value in a range of 1.25 to 1.96, and a value of not less than 3.44.

According to the third aspect of the present invention, it is possible to suppress the occurrence of the resonance in the liquid droplet-jetting head by adjusting the jetting frequency so that the ratio of the secondary mode inter-nozzle natural frequency to the jetting frequency is within the predetermined range.

BRIEF DESCRIPTION OF THE DRAWINGS

FIG. 8 shows a table showing an experimental result in relation to the crosstalk generated by the vibration shown in FIGS. 7A to 7C.

DESCRIPTION OF THE PREFERRED EMBODIMENTS

Preferred embodiments of the present invention will be explained below with reference to the drawings.

Outline of Printer

Figure 1:
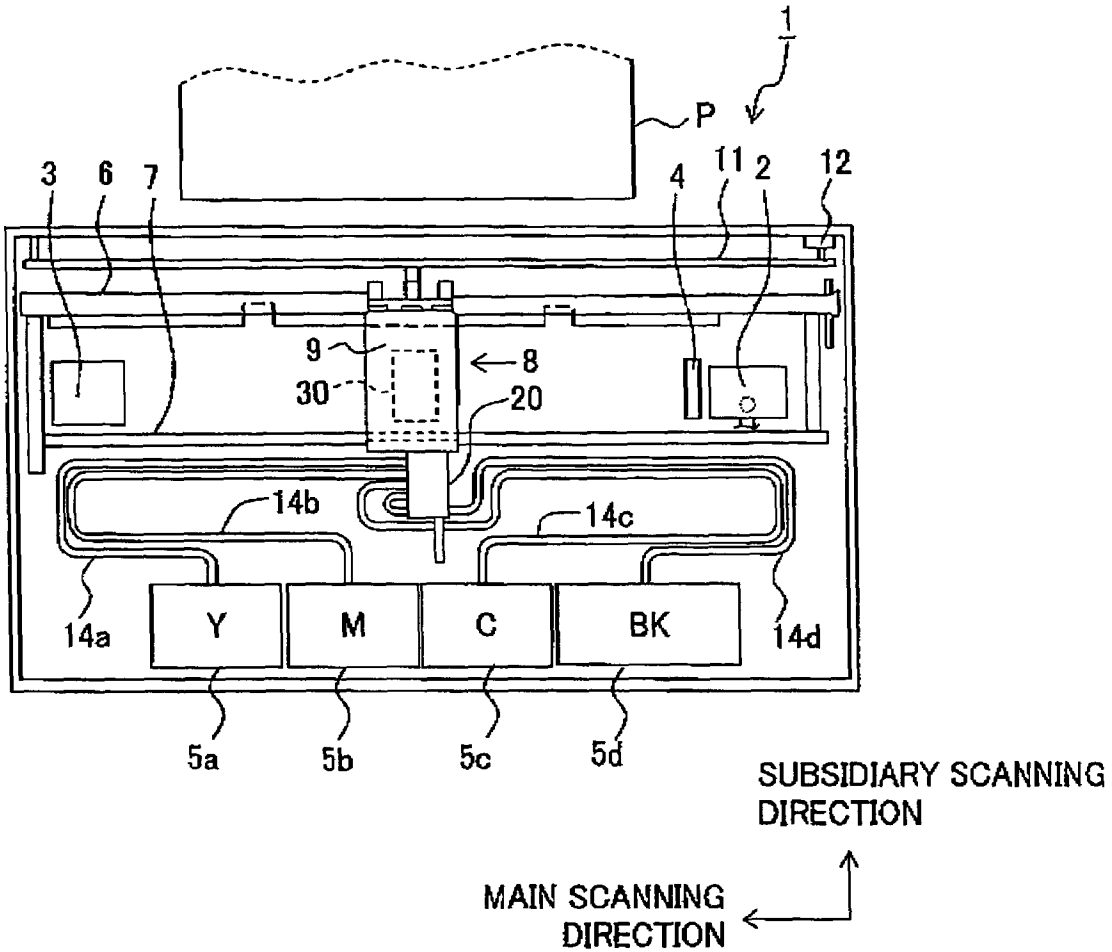
FIG. 1 shows a schematic top view illustrating an ink-jet printer 1 on which an ink-jet head body as an embodiment of the present invention is provided.

FIG. 1 shows a schematic top view illustrating an ink-jet printer 1 in which an ink-jet head body according to an exemplary embodiment of the present invention is provided. The ink-jet printer 1 will be referred to as "printer 1" below in an abbreviated manner.

Two guide shafts 6, 7 are provided in the printer 1. A head unit 8, which serves as a carriage, is provided on the guide shafts 6, 7 so that the head unit 8 is capable of reciprocating in the main scanning direction. The head unit 8 has a head holder 9 which is formed of a synthetic resin material. An ink-jet head 30, which performs the printing operation by discharging the inks onto the printing paper P transported to the position under or below the head unit 8, is held by the head holder 9.

A carriage motor 12 is provided on the printer 1. An endless belt 11, which is rotated in accordance with the driving operation of the carriage motor 12, is wound around the drive shaft of the carriage motor 12. The head holder 9 is attached to the endless belt 11. When the endless belt 11 is rotated, the head holder 9 can reciprocate in the main scanning direction.

The printer 1 has ink cartridges 5*a*, 5*b*, 5*c*, 5*d*. Yellow ink, magenta ink, cyan ink, and black ink are accommodated in the ink cartridges 5*a* to 5*d*, respectively. The ink cartridges 5*a* to 5*d* are respectively connected to a tube joint 20 provided on the head unit 8 by flexible tubes 14*a*, 14*b*, 14*c*, 14*d*, respectively. The inks, which are contained in the ink cartridges 5*a* to 5*d*, are supplied to the head unit 8 via the tube joint 20.

The printer 1 has an ink-absorbing member 3 which is provided at one end thereof in the main scanning direction defined by the guide shafts 6, 7. When the head unit 8 is moved to the end on the guide shafts 6, 7, the ink-absorbing member 3 is positioned just under the head unit 8. The ink-absorbing member 3 absorbs the inks discharged from nozzles formed on the nozzle surface of the head unit B when the flushing operation is performed. The printer 1 further has a purge unit 2 which is provided at the other end opposite to the ink-absorbing member 3 between the guide shafts 6, 7. The purge unit 2 absorbs the inks from the nozzles when the purge operation is performed.

The printer 1 has a wiper 4 which is provided at a position adjacent to the purge unit 2 in the main scanning direction between the guide shafts 6, 7. The wiper 4 wipes out the inks adhered to the nozzle surface.

Head Unit

Figure 2:
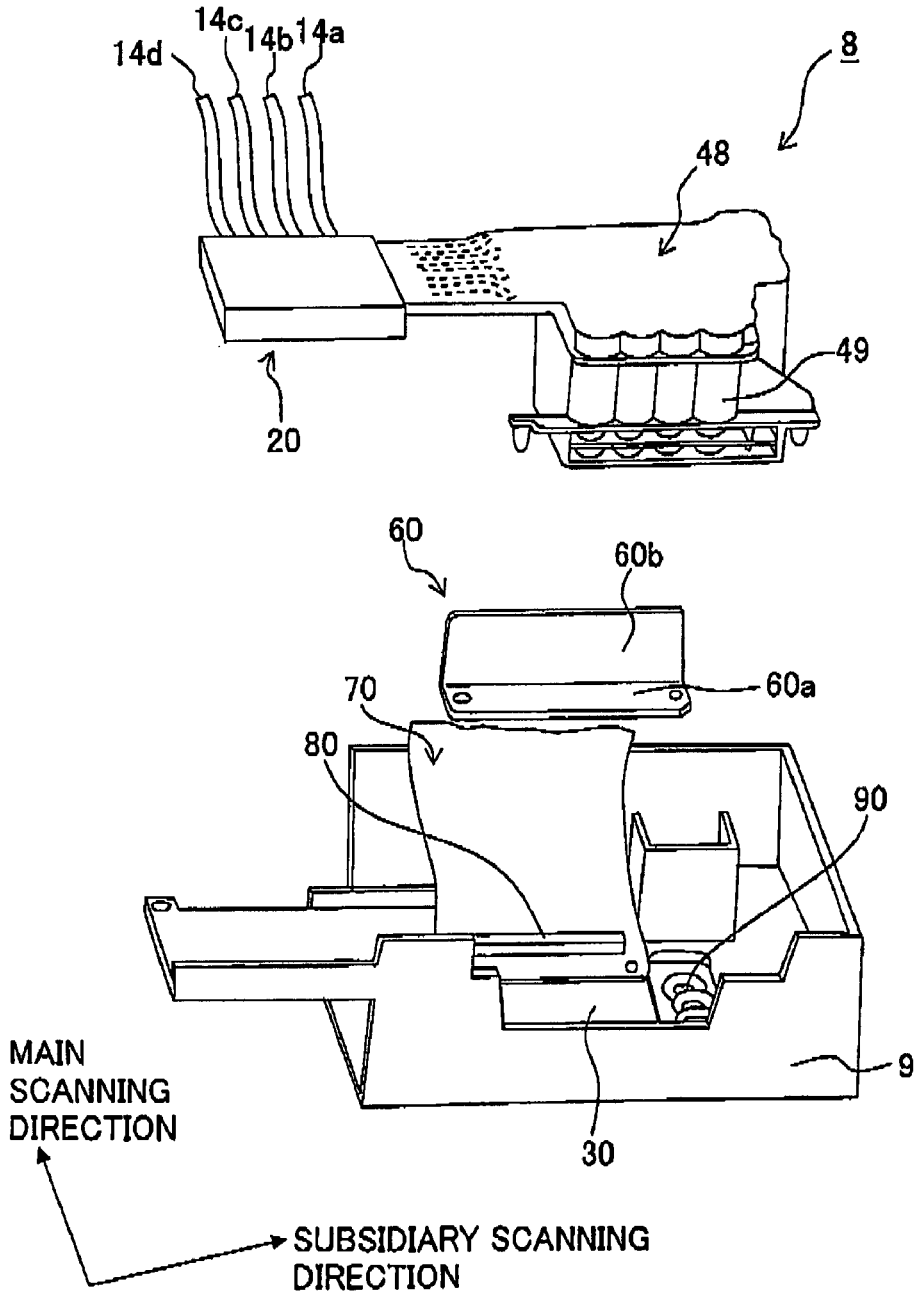
FIG. 2 shows an exploded perspective view illustrating a head unit shown in FIG. 1.

The head unit 8 will be explained. FIG. 2 shows a state in which a buffer tank 48 and a heat sink 60 are detached from the head holder 9 of the head unit 8.

The head holder 9 is formed to have a box-shaped form which is open toward the side on which the buffer tank 48 is received. The ink-jet head 30 is installed or arranged at a bottom portion of the head holder 9. The buffer tank 48 is accommodated in the head holder 9 so that the buffer tank 48 is positioned over or above the ink-jet head 30.

The tube joint 20 is connected to the buffer tank 48 at a portion in the vicinity of one end of the upper surface of the buffer tank 48. Unillustrated four ink outflow ports are provided on the lower surface of the buffer tank 48. The ink outflow ports are connected to four ink supply ports 91*a*, 91*b*, 91*c*, 91*c* provided on the ink-jet head 30 via a seal member 90 as described later on. As described above, the tube joint 20 is connected to the ink cartridges 5*a* to 5*d* via tubes 14*a*, 14*b*, 14*c*, 14*d*. The inks are supplied from the ink cartridges 5*a* to 5*d* via the tubes 14*a* to 14*d* to the buffer tank 48.

The head holder 9 has the heat sink 60. The heat sink 60 has a horizontal portion 60*a* which extends in the subsidiary scanning direction, and a vertical portion 60*b* which rises upwardly from one end of the horizontal portion 60*a*. As shown in FIG. 2, both of the horizontal portion 60*a* and the vertical portion 60*b* are formed to have plate-shaped forms which are long in the subsidiary scanning direction.

Flexible Printed Circuit (FFC) 70 is led or drawn upwardly from the head holder 9 via a gap provided at a bottom portion of the head holder 9 as described later on. One end of the FPC 70 is connected to a head body 25. A driver IC 8 is provided at an intermediate position thereof.

Figure 3:
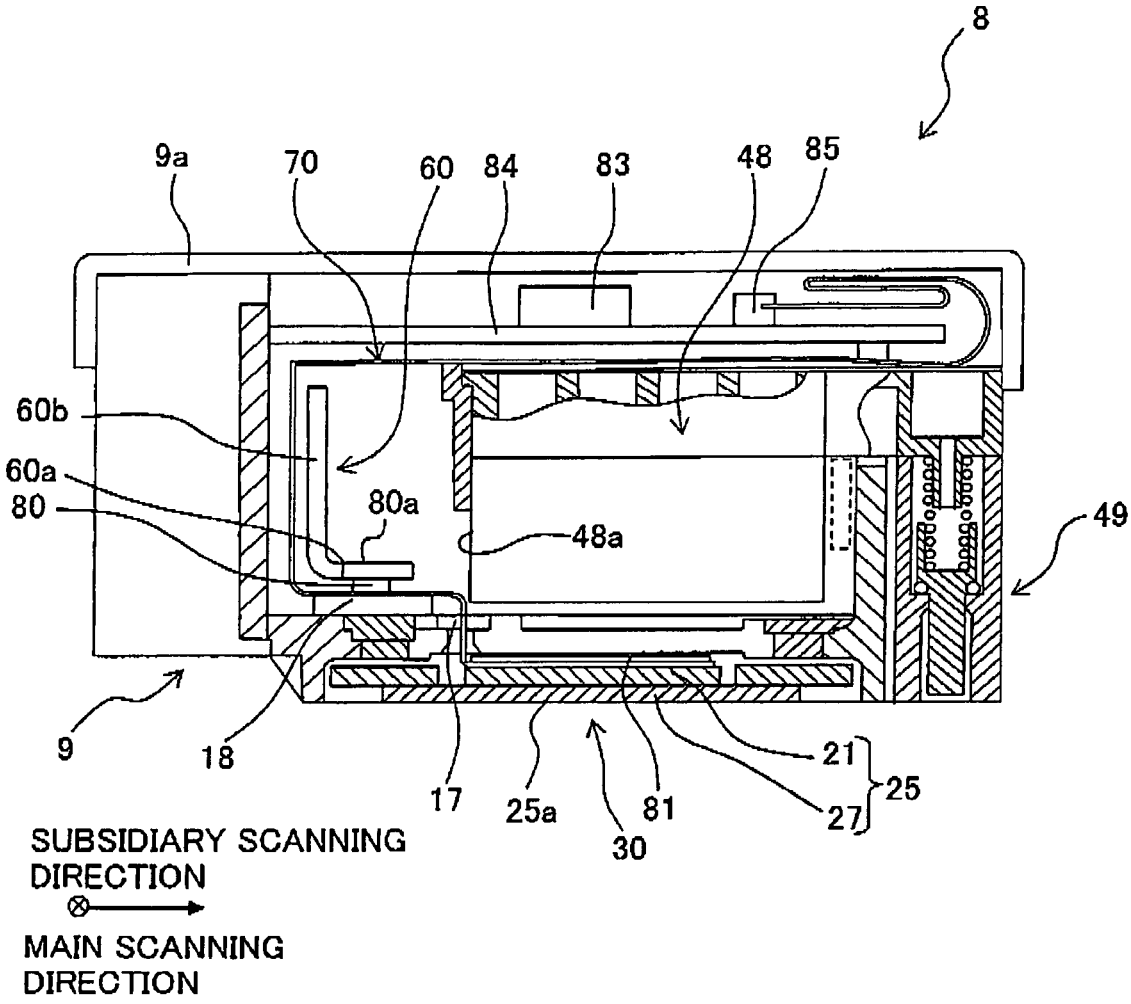
FIG. 3 shows a vertical sectional view illustrating the head unit shown in FIG. 1.

FIG. 3 shows a vertical sectional view illustrating the head unit 8 as sectioned in the main scanning direction. With reference to FIG. 3, a state is shown, in which the buffer tank 48 and the heat sink 60 are accommodated in the head holder 9.

The heat sink 60 is fixed at a position disposed adjacently to a side wall 48*a* on a side (left side as shown in FIG. 3) in the direction opposite to the main scanning direction of the buffer tank 48. One surface of the vertical portion 60*b* of the heat sink 60 is opposed to the side wall 48*a*. The horizontal portion 60*a* of the heat sink 60 is arranged on the bottom side of the head holder 9 so that the short direction of the horizontal portion 60*a* extends in the main scanning direction.

A control board 84, on which a connector 85 and electronic parts such as a capacitor 83 are mounted, is installed over the buffer tank 48. The upper space over the control board 84 is covered with a cover 9*a* which serves as an upper surface cover for the head holder 9.

A gas discharge unit 49, which discharges the air accumulated in the buffer tank 48 to the outside, is provided on a side surface on a side (right side in FIG. 3) in the main scanning direction of the buffer tank 48.

The ink-jet head 30, which is arranged in the bottom of the head holder 9, has the head body 25. The head body 25 is fixed to the bottom of the head holder 9 as described later on. A nozzle surface (bottom surface) 25*a*, in which a plurality of nozzles are formed, is arranged in the head body 25 so that the nozzle surface 25*a* is exposed outwardly in the downward direction of the head holder 9. The head body 25 has a piezoelectric actuator 21 and a flow passage unit 27 as described later on.

A portion of the FPC 70, which is disposed in the vicinity of one end thereof, is electrically connected to the piezoelectric actuator 21. The other end of the FPC 70 is led to the connector 85 installed over the buffer tank 48 via the following route, and the other end of the FPC 70 is electrically connected to the connector 85. At first, the FPC 70 is led upwardly via a hole 17 which is formed through a bottom portion of the head holder 9. Subsequently, the led FPC 70 is directed upwardly while passing through a gap formed between the heat sink 60 and the inner wall of the head holder 9. After that, the FPC 70 extends upwardly along one inner side surface of the head holder 9, and the FPC 70 is bent at a position disposed in the vicinity of the control board 84. Further, the FPC 70 extends in the main scanning direction along the lower surface of the control board 84, the FPC 70 is bent upwardly at a position in the vicinity of the other inner side surface of the head holder 9 to pass through a gap formed between the other inner side surface and the end of the control board 84, the FPC 70 is led to the side of the upper surface of the control board 84 on which the connector 84 is formed.

The driver IC 80 is provided on the FPC 70 as described above. The driver IC 80 is arranged on the surface of the FPC 70 opposed to or facing the horizontal portion 60*a* of the heat sink 60, which is positioned under the heat sink 60. Further, an elastic member 18 is arranged under the driver IC 80, the FPC 70 is pressed by the elastic member 18 so that the upper surface of the driver IC 80 makes contact with the horizontal portion 60*a* of the heat sink 60. Accordingly, any excessive heat of the heated driver IC 80 is released by the heat sink 60.

A heat transfer member 81 is arranged in the FPC 70 at an area opposed to the piezoelectric actuator 21. The heat transfer member 81 is an aluminum plate which has a uniform thickness and which has a rectangular shape in a planar view having a size approximately same as that of the upper surface of the piezoelectric actuator 21. Accordingly, the heat, which is generated by the piezoelectric actuator 21 and the portion of the FPC 70 opposed to the piezoelectric actuator 21, is released by the heat transfer member 81.

Head Body and the Like

Figure 4:
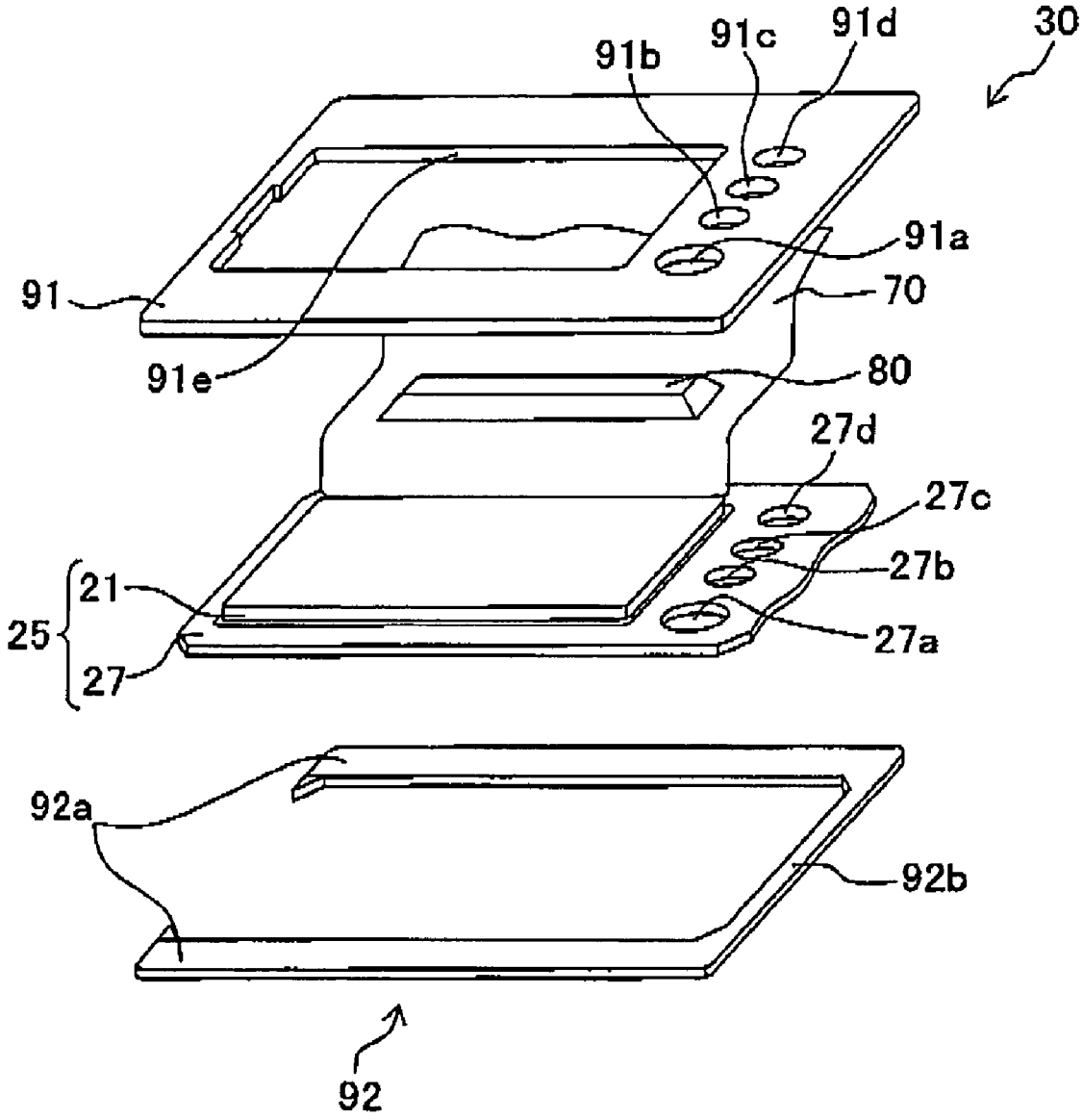
FIG. 4 shows an exploded perspective view illustrating an ink-jet head shown in FIG. 2.

The ink-jet head 30 will be explained. FIG. 4 shows an exploded perspective view illustrating the ink-jet head 30. The ink-jet head 30 has the head body 25, a reinforcing frame 91, and a protective frame 92. Upper surfaces of the head body 25, the reinforcing frame 91, and the protective frame 92 are shown in FIG. 4 respectively.

The head body 25 has the piezoelectric actuator 21 and the flow passage unit 27. The flow passage unit 27 is constructed of a stack formed by stacking a plurality of sheet members which have an identical shape and a rectangular shape in a planar view as described later on (see FIG. 5). Ink supply ports 27*a*, 27*b*, 27*c*, 27*d* are formed at portions in the vicinity of one end of the flow passage unit 27 in the longitudinal direction thereof. The ink supply ports 27*a* to 27*d* are arranged so that they are separated and isolated from each other in the short direction of the head body 25. The inks are supplied from the buffer tank 48 to the flow passage unit 27 via the ink supply ports 27*a* to 27*d*. The plurality of nozzles for discharging the inks are formed on the lower surface of the flow passage unit 27. Ink flow passages, which make communication from the ink supply ports 27*a* to 27*d* to the nozzles, are formed in the flow passage unit 27.

Further, the piezoelectric actuator 21 is provided on the flow passage unit 27 at the position on the upper surface thereof so that the piezoelectric actuator 21 does not interfere with the ink supply ports 27*a* to 27*d* as described later on. The piezoelectric actuator 21 constructs inner walls of parts of the ink flow passages (pressure chambers as described later on) formed in the flow passage unit 27. The discharge energy, which is exerted to discharge the ink from the nozzle by applying the pressure to the ink contained in the ink flow passage, is applied to the ink by the piezoelectric actuator 21, the FPC 70 is electrically connected to the piezoelectric actuator 21 as described above.

The reinforcing frame 91 is a plate-shaped member made of metal which has a rectangular shape in a planar view. An opening 91*e*, which is adapted to the piezoelectric actuator 21 of the head body 25, is formed in the reinforcing frame 91. The opening 91*e* has a shape approximately same as that of the planar shape of the piezoelectric actuator 21, but the shape of the opening 91*e* is greater to some extent than the planar shape of the piezoelectric actuator 21 as a whole. The opening 91*e* has the planar shape so that the opening 91*e* is accommodated inside the planar shape of the flow passage unit 27. In other words, the opening size of the opening 91*e* is larger to some extent than the outer shape of the piezoelectric actuator 21 as a whole, and the outer shape of the flow passage unit 27 is larger to some extent than the opening size of the opening 91*e* as a whole. The opening 91*e* is formed at a position in the vicinity of the center in the short direction of the reinforcing frame 91, while leaving a portion in the vicinity of one end of the reinforcing frame 91 in the longitudinal direction thereof.

Ink supply ports 91*a*, 91*b*, 91*c*, 91*d*, which penetrate through the reinforcing frame 91 in the thickness direction, are formed at portions deviated toward one end of the reinforcing frame 91 in the longitudinal direction. The ink supply ports 91*a* to 91*d* are formed corresponding to the ink supply ports 27*a* to 27*d*, respectively, of the flow passage unit 27. The ink supply ports 91*a* to 91*d* are arranged so that they are separated and isolated from each other in the short direction of the reinforcing frame 91. The respective ink supply ports 91*a* to 91*d* have shapes same as those of the respective ink supply ports 27*a* to 27*d* formed in the head body 25.

The protective frame 92 is a plate-shaped member made of metal which has a U-shape in a planar view. Two parallel arms 92*a* of the "U"-shape form of the protective frame 92 have a length approximately same as the length of the reinforcing frame 91 in the longitudinal direction of the reinforcing frame 91. A support portion 92*b*, which is perpendicular to the arms 92*a* and which supports the two arms 92*a* in the protective frame 92, has a length approximately same as the length of the reinforcing frame 91 in the short direction of the reinforcing frame 91. The area, which is surrounded by the "U"-shape form of the protective frame 92 in a plane including the cross-sectional plane of the protective frame 92, has a shape approximately same as that of the head body 25, but the area has a size which is greater to some extent than that of the head body 25 as a whole.

The ink-jet head 30 is formed by sticking the head body 25, the reinforcing frame 91, and the protective frame 92 to one another. The head body 25 and the reinforcing frame 91 are stuck to each other by the aid of a brazing filler metal so that the piezoelectric actuator 21 is accommodated in the through-hole (opening 91*e*) formed in the reinforcing frame 91; and that the peripheral portions of the piezoelectric actuator 21 on the upper surface of the flow passage unit 27 make contact with the lower surface of the reinforcing frame 91. The cavity plate 108 (see FIG. 5), which includes the upper surface of the flow passage unit 27, is entirely formed of a metal. The flow passage unit 27 and the reinforcing frame 91 may be stuck to each other by the aid of an adhesive. Accordingly, the upper surface of the piezoelectric actuator 21 is exposed upwardly from the opening 91*e* of the reinforcing frame 91. The protective frame 92 is stuck to the lower surface of the reinforcing frame 91 so that the flow passage unit 27 is surrounded by the "U"-shape form of the protective frame 92. In other words, the nozzle surface 25*a* of the flow passage unit 27 is exposed downwardly from the inner area of the "U"-shape form.

Note that the ink supply port 27*a* and the like are positioned and arranged so that the ink supply ports 91*a* to 91*d* are communicated with the ink supply ports 27*a* to 27*d* respectively when the reinforcing frame 91 and the head body 25 are stuck to each other.

As described above, the head body 25 is grasped at the portions around the ends on the four sides of the upper surface thereof by the reinforcing frame 91. The head body 25 is grasped at the peripheral portions of the side surfaces on the three sides by the protective frame 92. When the head body 25 is tightly grasped by the reinforcing frame 91 and the protective frame 92, the vibration, which is generated in the head body 25, is suppressed as described later on.

Structure of Head Body

Figure 5:
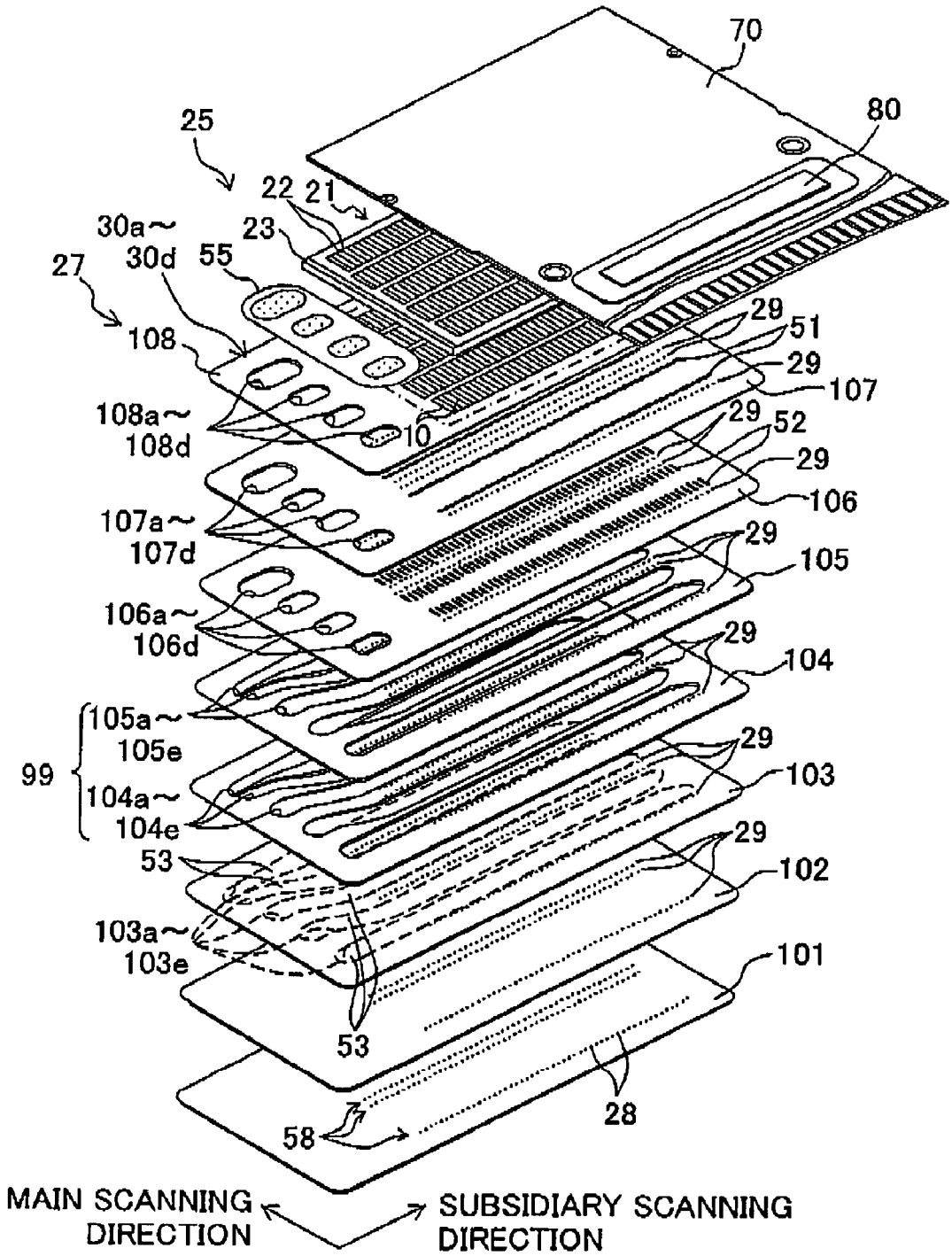
FIG. 5 shows an exploded perspective view illustrating a head body, a piezoelectric actuator, and FPC shown in FIG. 3.

The structure of the head body 25 will be explained in detail below. FIGS. 5 shows an exploded perspective view illustrating the head body 25 and the FPC 70.

As described above, the piezoelectric actuator 21 is arranged on the upper surface side of the head body 25. The piezoelectric actuator 21 is formed by stacking a plurality of thin plates each having a rectangular shape in a plan view as described later on. Surface electrodes 22, 23 are arranged on the upper surface of the piezoelectric actuator 21. The surface electrodes 22, 23 are electrically connected to unillustrated contacts (terminals) of the FPC 70 corresponding thereto.

A filter 55 is stuck or adhered to the upper surface of the head body 25 (flow passage unit 27) to cover the ink supply ports 30*a* to 30*d* therewith. The filter 55 has a plurality of minute holes which are formed at positions opposed to the ink supply ports 30*a* to 30*d*, respectively. The inks, which are outflowed from unillustrated outflow ports of the buffer tank 43, are filtrated by the filter 55, and the inks are allowed to flow into the flow passage unit 27 from the ink supply ports 30*a* to 30*d*.

The flow passage unit 27 has a stacked structure constructed by staking eight in total of sheet members which are a cavity plate 108, a supply plate 107, an aperture plate 106, two manifold plates 104, 105, a damper plate 103, a cover plate 102, and a nozzle plate 101 disposed in this order from the top. The respective plates 101 to 108 have rectangular shapes in a planar view which are long in the subsidiary scanning direction. In this embodiment, the eight plates 101 to 108, which construct the flow passage unit 27, are formed of stainless steel. The seven plates 102 to 108, excluding the nozzle plate 101, may be formed of stainless steel, and the remaining nozzle plate 101, may be formed of polyimide resin.

The nozzle plate 101 has a large number of nozzles 28 each of which has a minute diameter and which are formed at minute intervals. The nozzles 28 are arranged in a form of zigzag arrangement in the longitudinal direction (subsidiary scanning direction) of the nozzle plate 101 to construct five nozzle rows 58.

A plurality of pressure chambers 10 corresponding to the nozzles 28, respectively, which are of a number same as that of the nozzles 28, are formed in the cavity plate 108. The pressure chambers 10 are arranged in five rows in a zigzag arrangement in the longitudinal direction of the cavity plate 108. The longitudinal direction of each of the pressure chambers 10 is perpendicular to the longitudinal direction of the cavity plate 108. Through-holes 29 having minute diameters are formed in a zigzag arrangement in each of the plates of the plates 102 to 107. One end of each of the pressure chambers 10 is communicated with one of the nozzles 28 in the nozzle plate 101 via one of the through-holes 29. The through-holes 29 construct through-hole rows in the longitudinal direction, in each of the plates.

Through-holes 108*a*, 108*b*, 108*c*, 108*d* are formed in the cavity plate 108 at one end thereof in the longitudinal direction. Openings of the through-holes 108*a* to 108*d*, on the upper surface side of the flow passage unit 27, correspond to the ink supply ports 30*a* to 30*d*, respectively. That is, the through-holes 108*a* to 108*d* are arranged in an order of a, b, c, d in the direction directed from the back to the front of FIG. 5 in the short direction (main scanning direction) of the cavity plate 108. The through-hole 108*a*, which is included in the four through-holes 108*a* to 108*d*, has an opening which is larger to some extent than those of the other through-holes 108*b* to 108*d* as a whole.

Communication holes 51, which are of the same number as that of the nozzles 28, are formed in the supply plate 107, in addition to the through-holes 29 communicated with the nozzles 28. The communication holes 51 penetrate through the supply plate 107 in the thickness direction. The communication holes 51 are arranged in five rows in a zigzag form in the longitudinal direction of the supply plate 107. One opening of each of the communication holes 51 is communicated with the other end of one of the pressure chambers 10 corresponding thereto. The other opening of each of the communication holes 51 is communicated with an aperture 52 corresponding thereto as described later on.

Through-holes 107*a*, 107*b*, 107*c*, 107*d*, which have shapes and sizes same as those of the through-holes 108*a* to 108*d*, respectively, are formed on the side of one end of the supply plate 107 in the longitudinal direction. The through-holes 107*a* to 107*d* are arranged so as to face or oppose to the through-holes 108*a* to 108*d*, respectively, in the cavity plate 108.

Apertures 52 (throttles), which are of the same number as that of the nozzles 28, are formed in the aperture plate 106, in addition to the through-holes 29. The apertures 52 are arranged in five rows in a zigzag form in the longitudinal direction of the aperture plate 106. Each of the apertures 52 has a rectangular shape in a planar view, and extends in the short direction of the aperture plate 106. One end of each of the apertures 52 is communicated with one of the communication holes 51, and the other end of the aperture 52 is communicated with a common ink chamber 99 as described later on. The cross-sectional area of the aperture 52, which relates to the cross section perpendicular to the direction from one end and the other end of the aperture 52, is set to have a predetermined size. In other words, the cross-sectional shape, the cross-sectional area, and the length of the aperture 52 are determined so that a specified flow passage resistance is obtained. Accordingly, the flow of the ink, which intends to cause any counterflow (reverse flow) from the pressure chamber 10 to the common ink chamber 99 during the ink discharge, is restricted.

Through-holes 106*a*, 106*b*, 106*c*, 106*d*, which have shapes and sizes same as those of the through-holes 107*a* to 107*d*, respectively, are formed on one end side in the longitudinal direction of the aperture plate 106. The through-holes 106*a* to 106*d* are arranged so as to face or oppose to the through-holes 107*a* to 107*d*, respectively, of the cavity plate 108.

The through-holes 106*a* to 106*d*, the through-holes 107*a* to 107*d*, and the through-holes 105*a* to 105*d* are communicated with one another in a state in which the cavity plate 108, the supply plate 107, and the aperture plate 106 are stacked. Accordingly, the ink flow passages are formed in which the inks flow into the flow passage unit 27, via the through-hole 106*a* and the like from the ink supply ports 30*a* to 30*d*.

Five ink chamber-half portions 105*a*, 105*b*, 105*c*, 105*d*, 105*e* are formed in the manifold plate 105 which is included in the two manifold plates 104, 105 and which is disposed nearer to the aperture plate 106. The five ink chamber-half portions 105*a*, 105*b*, 105*c*, 105*d*, 105*e* are formed penetratingly in the thickness direction. The ink chamber-half portions 105*a* to 105*e* extend in the longitudinal direction of the manifold plate 105 so that the ink chamber-half portions 105*a* to 105*e* do not interfere with the through-hole rows formed of the through-holes 29. The ink chamber-half portions 105*a* to 105*e* are arranged in an order of a, b, c, d, e in the direction directed from the back to the front of FIG. 5 in the short direction of the manifold plate 105. The ink chamber-half portions 105*a* to 105*e* are arranged in parallel to one another while being separated and isolated from one another.

Ink chamber-half portions 104*a*, 104*b*, 104*c*, 104*d*, 104*e*, which have shapes and sizes same as those of the ink chamber-half portions 105*a* to 105*e*, respectively, are formed also in the manifold plate 104 which is included in the manifold plates 104, 105 and which is disposed on the side of the damper plate 103. The ink chamber-half portions 104*a*, 104*b*, 104*c*, 104*d*, 104*e* are formed penetratingly in the thickness direction so that the ink chamber-half portions 104*a* to 104*e* are opposed to the ink chamber-half portions 105*a* to 105*e*, respectively.

Two ink chamber-half portions, which are opposed to each other and which are included in the ink chamber-half portions 104*a* to 104*e* and 105*a* to 105*e*, respectively, are connected to each other in a state in which the two manifold plates 104, 105, the aperture plate 106, and the damper plate 103 are stacked. One openings of the ink chamber-half portions 104*a* to 104*e* are covered with the aperture plate 106, and the other openings of the ink chamber-half portions 104*a* to 104*e* are covered with the damper plate 103. Accordingly, one ink chamber is formed by the two ink chamber-half portions which are opposed to each other, and the five common ink chambers 99 are formed in total. The common ink chambers 99 extend in the areas of the two manifold plates 104, 105 in which the through-holes 29 are not formed.

The through-hole 106*a* is communicated with the ink chamber-half portions 105*a*, 105*b* in a state in which the aperture plate 106 and the manifold plate 105 are stacked. Further, the through-holes 106*b* to 106*d* are communicated with the ink chamber-half portions 105*c* to 105*e*, respectively. Accordingly, the same ink is supplied from one ink supply port 30*a* to the two common ink chambers 99 which are included in the five common ink chambers 99 and which are positioned at the back as viewed in FIG. 5. The inks, which are to be fed from the respective ink supply ports 30*b* to 30*d* corresponding to the other three respective common ink chambers 99, respectively, are supplied to the other three respective common ink chambers 99. In this embodiment, the black ink is supplied to the two common ink chambers 99 disposed at the back as viewed in FIG. 5. The yellow, magenta, and cyan inks are supplied in this order to the three common ink chambers 99, respectively, arranged in the direction directed from the front to the back as shown in FIG. 5.

Damper grooves 103*a*, 103*b*, 103*c*, 103*d*, 103*e* are formed in the surface of the damper plate 103, on the side of the cover plate 102. Each of the damper grooves 103*a* to 103*e* is formed to be groove-shaped so that the vertical cross section in the short direction of the damper plate 103, has a recessed shape. The damper grooves 103*a* to 103*e* extend in the longitudinal direction of the damper plate 103. The damper grooves 103*a* to 103*e* have shapes and sizes same as those of the corresponding common ink chambers 99, respectively, and are opposed to the respective common ink chambers 99.

Damper portions 53 are arranged in the damper plate 103 at portions thereof opposed to the common ink chambers 99 in a state in which the manifold plates 104, 105 and the damper plate 103 are stacked. Thin-walled portions of the damper portions 53 of the damper plate 103 are elastically deformable in an appropriate manner, and can be vibrated toward the common ink chambers 99 and toward the damper groove 103*a*. Therefore, even when the pressure fluctuation (pressure wave), which is generated in a certain pressure chamber of the pressure chambers 10 during the ink discharge, is propagated or transmitted to the common ink chamber 99, the thin-walled portion of the damper portion 53, which is opposed to the common ink chamber 99, is elastically deformed. Accordingly, the pressure fluctuation, which is transmitted to the common ink chamber 99, is absorbed and attenuated by the damper portion 53. Therefore, the ink discharge of another pressure chamber 10 adjacent to the certain pressure chamber 10 is not affected, which would be otherwise affected by the ink.

Through-holes 29 are formed in the cover plate 102. The nozzles 28 are formed in the nozzle plate 101. When the plates 101 to 107 are stacked, the flow passages, which range from the portions on one end side of the pressure chambers 10, via the through-holes 29 in each of the respective plates, to the nozzles 28, respectively, are formed as described above.

The flow passage unit 27 has the stacked structure in which the respective plates 101 to 108 constructed as described above are stacked. Owing to the stacked structure as described above, the plurality of ink flow passages are formed in the flow passage unit 27, which range from the ink supply ports 30*a* to 30*d* via the common ink chambers 99, the apertures 52, the communication holes 51, the pressure chambers 10, and the through-holes 29 to arrive at the nozzles 28, respectively. The inks, which are flowed into the flow passage unit 27 from the buffer tank 48 via the ink supply ports 30*a* to 30*d*, are once stored in the common ink chambers 99. The inks are then supplied to the pressure chambers 10, via the apertures 52, respectively. The inks, to which the pressure is applied by the piezoelectric actuator 21 in the respective pressure chambers 10, are discharged from the corresponding nozzles 28 via the respective through-holes 29.

Piezoelectric Actuator

Figure 6:
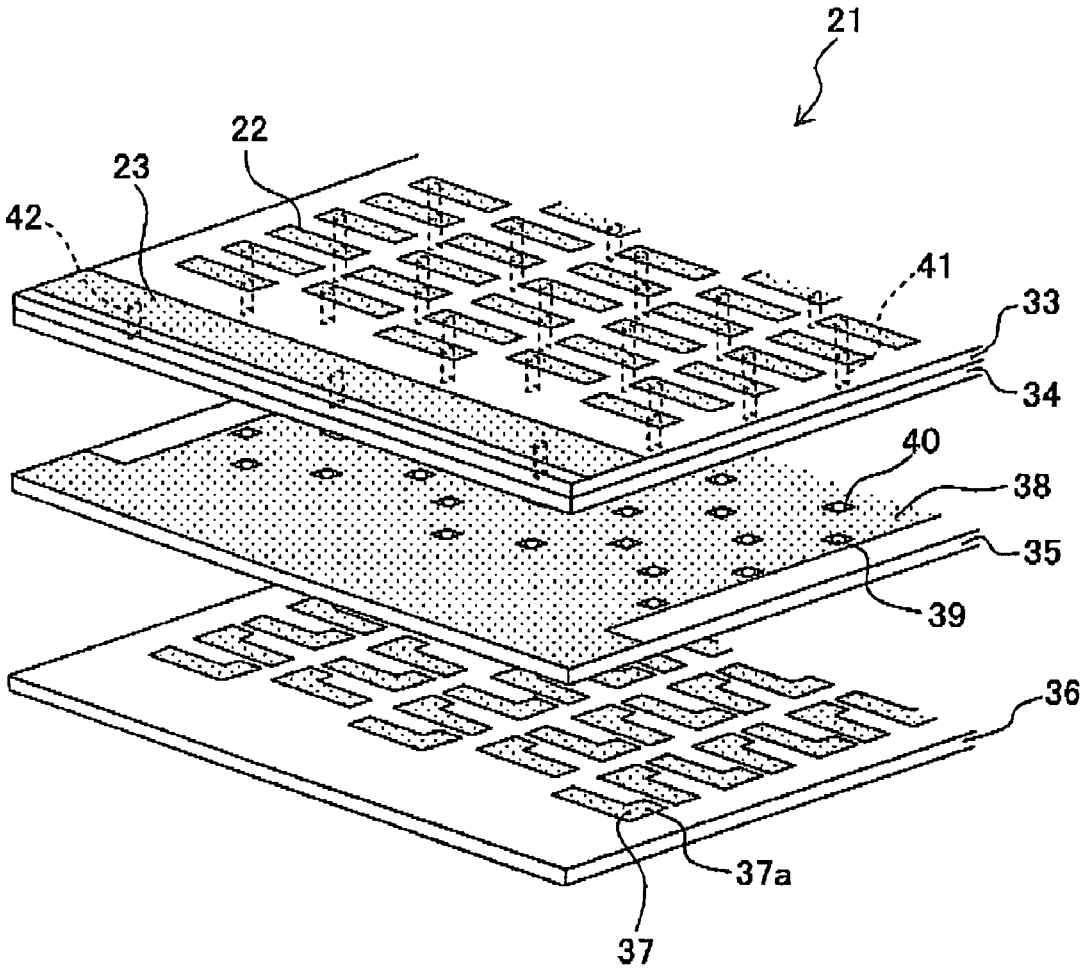
FIG. 6 shows an exploded perspective view illustrating the piezoelectric actuator shown in FIG. 3.

The piezoelectric actuator will be explained. FIG. 6 shows an exploded perspective view illustrating main parts or components of the piezoelectric actuator 21 shown in FIG. 5.

The piezoelectric actuator 21 includes two insulating sheets 33, 34 and two piezoelectric sheets 35, 36 which are stacked. A plurality of individual electrodes 37 are formed on the upper surface of the piezoelectric sheet 36 so that the individual electrodes 37 are arranged opposingly to or facing the pressure chambers 10, respectively, in the flow passage unit 27. The individual electrodes 37 are arranged in five rows in a zigzag form in the longitudinal direction of the piezoelectric sheet 36, corresponding to the arrangement of the pressure chambers 10. Each of the individual electrodes 37 has a portion which has a rectangular shape in a planar view and which is long in the short direction of the piezoelectric sheet 36. Each of the individual electrodes 37 has a lead-out portion 37*a* which is extended in the longitudinal direction of the piezoelectric sheet 36, from one end of the rectangular portion of the lead-out portion 37 in the longitudinal direction. In each of the lead-out portions 37*a* is led or drawn to an area, of the piezoelectric sheet 36, in which the lead-out portion 37*a* is not opposed to or facing the pressure chamber 10.

A common electrode 38, which covers the plurality of pressure chambers 10, is provided on the upper surface of the piezoelectric sheet 35. A plurality of no-formation areas 39, in which the common electrode 38 is not formed, are arranged on the upper surface of the piezoelectric sheet 35. A through-hole 40, which penetrates in the thickness direction of the piezoelectric sheet 35, is formed in each of the no-formation areas 39. The through-hole 40 is filled with a conductive member in a state of being electrically insulated from the common electrode 38. The no-formation areas 39 are arranged at positions at which the no-formation areas 39 are opposed to the lead-out portions 37*a* of the individual electrodes 37, respectively.

Surface electrodes 22 corresponding to the individual electrodes 37 respectively, and a surface electrode 23 are provided on the upper surface of the insulating sheet 33 disposed at the uppermost layer (i.e., on the upper surface of the piezoelectric actuator 21). The surface electrodes 22 are formed at areas in which the surface electrodes 22 are not opposed to the pressure chambers 10 in the insulating sheet 33, so that the surface electrodes 22 are opposed to the through-holes 40 (or the lead-out portions 37*a*), respectively. The surface electrodes 22 are arranged in five rows in a zigzag form in the longitudinal direction of the piezoelectric actuator 21, corresponding to the individual electrodes 37, respectively. The surface electrode 23 extends in the short direction of the piezoelectric actuator 21, in the insulating sheet 33 at a portion in the vicinity of one end thereof in the longitudinal direction.

A plurality of continuous holes 41, which penetrate in the thickness direction of the insulating sheets 33, 34, are formed in the insulating sheets 33, 34 at positions opposed to the through-holes 40 and in areas of the insulating sheets 33, 34 in which the continuous holes 41 are opposed to the surface electrodes 22 and the lead-out portions 37*a*. Three continuous holes 42 are formed in the insulating sheets 33, 34 at areas in which the continuous holes 42 are opposed to the surface electrode 23 and the common electrode 38, while being separated and isolated from one another in the short direction of the insulating sheets 33, 34. The continuous holes 41, 42 are filled with conductive members.

The piezoelectric actuator 21 has the stacked structure including the insulating sheets 33, 34 and the piezoelectric sheets 35, 36 which are constructed as described above, and which are stacked in this order from the top. In the stacked structure as described above, the through-holes 40 and the continuous holes 41 are positionally adjusted so that the holes 40, 41 are just opposed to one another, while the respective sheet-shaped members are stacked. Accordingly, a plurality of through-holes are formed, in which the through-holes 40 and the continuous holes 41 are communicated with one another to penetrate through the insulating sheets 33, 34 and the piezoelectric sheet 35. The through-holes are filled with the conductive members as described above. Therefore, the surface electrodes 22 and the individual electrodes 37 are electrically connected to one another. The continuous holes 42, which are formed through the insulating sheets 33, 34, are also filled with the conductive member as described above. Therefore, the surface electrode 23 and the common electrode 38 are electrically connected to one another.

Owing to the arrangement as described above, the individual electrodes 37 of the piezoelectric actuator 21 are connected to unillustrated individual wirings, respectively, provided on the FPC 70 via the surface electrodes 22. Further, the common electrode 38 is connected to an unillustrated common wiring provided on the FPC 70 via the surface electrode 23. Each of the individual wirings is connected to the driver IC 80.

On the other hand, printing signal, which is serially transmitted from an unillustrated control unit provided on the printer 1, is converted by the driver IC 80 into parallel signal corresponding to each of the individual electrodes 37 of the piezoelectric actuator 21. The driver IC 80 generates driving signal having a predetermined voltage pulse based on the printing signal. The driver XC 80 outputs the generated driving signal to each of the individual wirings connected to one of the individual electrodes 37. The common wiring is always kept at the ground electric potential.

Accordingly, the driving voltage (driving signal), which is fed from the driver IC 80, is selectively applied between a desired individual electrode 37 and the common electrode 38 of the piezoelectric actuator 21. When non-zero voltage is applied between the individual electrode 37 and the common electrode 38, the deformation is generated in the stacking direction in an active portion of the piezoelectric sheet interposed between the individual electrode 37 and the common electrode 38. The pressure is applied by the deformation generated in the active portion to the ink in the pressure chamber 10 of the cavity plate 108, thereby discharging (jetting) the ink from a nozzle 28 corresponding to the individual electrode 37.

When the printing is performed by the printer 1, the printing is performed while transporting the printing paper p to a position under or below the ink-jet head 30 (see FIG. 1). At this time, the velocity at which the printing paper P is transported is determined based on the resolution of the printing and the number of times that the ink is discharged from the nozzles 28 per unit time. In the following explanation, the printing cycle (printing period) means a time required for the printing paper P to move, when the printing is performed, relative to the ink-jet head 30 by a unit distance corresponding to the resolution of the printing. The printing frequency is the reciprocal of the printing cycle. In this embodiment, the printing frequency is not more than 30 kHz.

Crosstalk Caused by Ink Discharge

As described above, the printer 1 is capable of selectively discharging the ink from the nozzles 28 formed in the ink-jet head 30. When the ink is discharged by a certain nozzle 28, the vibration, which is generated thereby, is propagated to the entire ink-jet head 30. The vibration, which is generated by the discharge operation by the certain nozzle 28, is propagated to another nozzle 28 to harmfully affect the discharge operation of the another nozzle in some cases. In other cases, the vibration harmfully affects the next discharge operation to be performed by the nozzle 28 itself which has discharged the ink. The phenomenon, in which the influence of the vibration or the like caused by the discharge operation of a certain nozzle 28 is exerted on the discharge operation of another nozzle 28 as in the former case, is called "crosstalk".

Figure 7A:
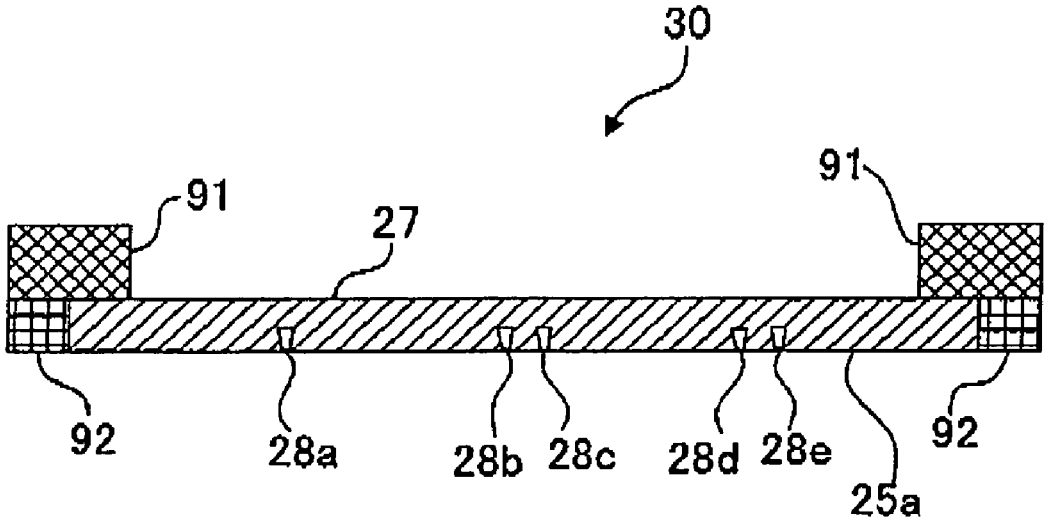
FIG. 7A schematically shows the ink-jet head shown in FIG. 3.

The crosstalk will be explained below. FIG. 7 shows a magnified view illustrating main parts or components of the ink-jet head 30 shown in FIG. 3, which depicts a sectional view as sectioned in the short direction of the flow passage unit 27. For better understanding of the drawing, the nozzles 28, which are formed for the flow passage unit 27, are depicted in an exaggerated manner in FIG. 7 as compared with actual ones. The ink flow passages and the piezoelectric actuator 21, except for the nozzles 28, are omitted from the illustration as well. The nozzles 28*a*, 28*b*, 28*c*, 28*d*, 28*e* belong to the mutually different nozzle rows 58 respectively (see FIG. 5). Each of the nozzle rows 58 extends in the direction perpendicular to the sheet surface of the drawing.

As described above, when the ink is discharged from a certain nozzle 28, the vibration is generated in the ink-jet head 30 at a position thereof at which the nozzle 28 is formed. The vibration as described above generates a traveling wave or progressive wave in which the vibration is propagated to the entire surroundings along with the area in which the flow passage unit 27 extends. On the other hand, as shown in FIG. 7, the circumference or periphery of the flow passage unit 27 is grasped by the reinforcing frame 91 and the protective frame 92. Therefore, the vibration, which is propagated through the flow passage unit 27, is reflected at the circumference of the flow passage unit 27. When the flow passage unit 27 is vibrated at a frequency which is close to the proper vibration (oscillation) frequency or the natural frequency of the flow passage unit 27, the amplitude of the vibration of the flow passage unit 27 is increased. That is, the flow passage unit 27 is resonated.

The natural frequency is the value which is inherent in an object. In the case of the part like the ink-jet head 30 of this embodiment which is formed while involving no or little deviation in the dimension and the density, it is considered that the individual difference in the natural frequency hardly appears (roughly about 5%). The natural frequency f is represented by $f=(K/m)^{1/2}$ in the spring-mass system in which the spring constant is K and the mass is m. K corresponds to the elastic modulus of the material. Therefore, in general, as the material for forming the object is harder, the natural frequency becomes higher. As the mass of the object is lighter, the natural frequency becomes higher. In general, the fixation of the object functions to inhibit the deformation of the object. Therefore, when the object is fixed, it is considered that the natural frequency is increased In order to measure the natural frequency of the object, for example, the measurement object is vibrated by striking the measurement object with a hammer or the like while holding the measurement object so that the measurement object is not restricted as much as possible. The vibration is detected with a sensor to perform the processing with FFT analyzer. Accordingly, the frequency spectrum (intensity distribution of the frequency) is obtained. The natural frequency can be determined from the peak of the frequency spectrum. Alternatively, the measurement object is vibrated with a frequency-variable exciting unit, and the amplitude of the vibration of the measurement object is detected with a sensor. The exciting frequency of the exciting unit is scanned to determine a frequency (resonance frequency) at which the amplitude of the vibration of the measurement object is increased. Accordingly, the natural frequency can be determined as well.

In this embodiment, the plurality of common ink chambers 99, which are parallel to the nozzle surface 25*a* and which extend in parallel to the nozzle rows 58, are formed in the flow passage unit 27. Therefore, the vibration easily arises in the direction along with a line segment connecting two nozzles which belong to the different nozzle rows 58, respectively. When the resonance is caused, the nozzle surface 25*a* is vibrated in a two-dimensional manner. However, in this case, the crosstalk between the two nozzles is generated by the component of the vibration concerning the direction along the line segment connecting the two nozzles.

Figure 7B:
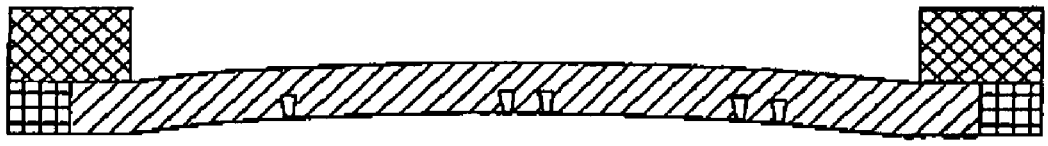
FIG. 7B shows a situation in which the ink-jet head is vibrated in the primary mode of the proper vibration.
Figure 7C:
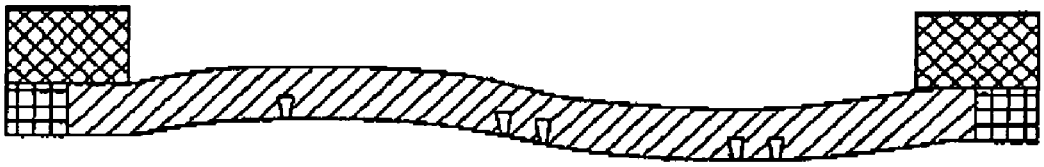
FIG. 7C shows a situation in which the ink-jet head is vibrated in the secondary mode of the proper vibration.

FIGS. 7B and 7C show situations in which the nozzle surface 25*a* is vibrated in a direction (direction between the nozzles) along a line connecting a nozzle 28 (for example, nozzle 28*a*) belonging to a certain nozzle row 58 and another nozzle 28 (for example, nozzle 28*e*) belonging to another nozzle row 58, when the flow passage unit 27 is resonated. FIGS. 7B and 7C show vibrations of the primary mode and the secondary mode in the vibration as described above, respectively. The primary mode and the secondary mode mean the vibration modes in which the numbers of the node except for the both ends are 0 and 1, respectively.

In general, regarding the object which is in vibration, the velocity is maximized at the moment at which the amplitude is zero, and the acceleration is maximized at the moment at which the amplitude is maximized. When a plurality of objects are vibrated at an identical cycle, an object, which is vibrated at a large amplitude, has the maximum velocity which is larger than the maximum velocity of another object which is vibrated at a small amplitude. Further, when the masses of the objects are approximately identical, the maximum acceleration, which is exerted on the object vibrated at a large amplitude, is larger than the maximum acceleration of the another object vibrated at a small amplitude. With reference to FIG. 7B, portions of the flow passage unit 27, at which the nozzles 28*b*, 28*c* are formed, respectively, are disposed closely to a portion (so-called the antinode portion) at which the amplitude is the greatest. That is, when the vibration of the nozzle surface 25*a* of the flow passage unit 27 is considered, the portions, of the nozzle surface 25*a*, at which the nozzles 28*b*, 28*c* are formed, are vibrated at the amplitude greater than the amplitude of portions at which the nozzles 28*a*, 28*e* are formed, respectively. Therefore, the portions, at which the nozzles 28*b*, 28*c* are formed, have the maximum velocity and the maximum acceleration which are greater than the maximum velocity and the maximum acceleration of the portions at which the nozzles 28*a*, 28*e* are formed and which have the relatively small amplitude. For example, when the flow passage unit 27 is being deformed in an upwardly convex form (to project upwardly), the ink is discharged toward the recording medium while the nozzle surface 25*a* is being separated and away from the recording medium. Therefore, the effective discharge velocity (velocity with respect to the recording medium) of the ink discharged from the nozzle is decreased as compared with the discharge velocity with respect to the nozzle surface 25*a*. The influence of this phenomenon is exerted more intensely at positions disposed nearer to the vicinity of the center in the left and right direction in FIG. 7B. In other words, the nozzle, which is positioned in the vicinity of the center as described above, discharges the ink having the small flying velocity when the flow passage unit 27 is being deformed in an upwardly convex form, and the nozzle discharges the ink having the large flying velocity when the flow passage unit 27 is being deformed in a downwardly convex form.

With reference to FIG. 7C, the relationship of antiphase holds between the vibration at the portion at which the nozzle

28*a* is formed and the vibration at the portions at which the nozzles 28*d*, 28*e* are formed. Therefore, the velocity and the acceleration, which are brought about by the vibration, greatly differ between the nozzle 28*a* and the nozzles 28*d*, 28*e*, For example, when the portion disposed in the vicinity of the nozzle 28*a* is deformed in an upwardly convex form, and the portion disposed in the vicinity of the nozzle 28*e* is deformed in a downwardly convex form, then the effective discharge velocity of the ink discharged from the nozzle 28*a* is decreased, and the effective discharge velocity of the ink discharged from the nozzle 28*e* is increased. In other words, the flying velocity of the ink mutually differs therebetween depending on the position of the nozzle. When the velocity and the acceleration differ among the different nozzles depending on the portions at which the nozzles are formed as described above, the discharge characteristics of the ink differ among the nozzles. The phenomenon as described above is the crosstalk, when the crosstalk arises during the printing, the ink discharge amount and the discharge velocity are varied among the nozzle rows 58. As a result, the reproducibility of the printed image is lowered, for example, such that any unexpected difference in density appears on the printed image.

The tendency or easiness of the appearance of the resonance caused by the ink discharge as described above is changed depending on the printing frequency. For example, when the printing is performed at a printing frequency which is close to the proper vibration frequency concerning the primary mode of the proper vibration, the amplitude of the primary mode of the proper vibration is increased. Therefore, the degree or extent of the crosstalk generated in the ink-jet head 30 is changed depending on the printing frequency during the printing.

FIG. 8 shows a table showing the situation of the occurrence of the crosstalk when the printing is performed at various printing frequencies with one ink-jet head 30. In FIG. 8, the items, which are included in the second column from the left, indicate, at four grades, the judgment of the crosstalk when the printing is performed at the printing frequency shown in the first column. In particular, a symbol "++" indicates a case in which the crosstalk is not generated or the crosstalk is almost absent. A symbol "+" indicates a case in which no problem arises in the practical use although the crosstalk is observed. A symbol "±" indicates a case in which the crosstalk is present but the crosstalk is to such an extent that the practical use minimally holds. A symbol "−" indicates a case in which the crosstalk is great and the practical use does not hold. The judgment is made by confirming whether or not the influence of the crosstalk (for example, the change of the dot side, the positional deviation, and the appearance of any minute dot) appears on the printed image by the visual observation (micrographic observation or photographic judgment). The ink-jet head 30 used in this measurement is formed by sticking the head body (F/E) 25, the reinforcing frame (FE frame) 91, and the protective frame 92 as described above. The head body 25 is formed by sticking the nozzle plate 101 made of polyimide, the plates made of 42 alloy (flow passage substrates) 102 to 107, and the piezoelectric actuator (PZT) 21. In the case of the head body described above, the nozzle plate is made of metal as well. However, the nozzle plate used in this measurement is made of polyimide. The plates 102 to 107 have a width of 17.2 mm and a thickness of about 0.6 mm. The piezoelectric actuator 21 and the reinforcing frame 91 have thicknesses of about 0.3 mm and 1.2 mm, respectively. The upper portion of the reinforcing frame 91 is completely restricted, and the reinforcing frame 91 is fixed to the printer at this portion. The characteristic value analysis was performed by using a two-dimensional plane deformation model to calculate the natural frequency for the proper vibration in the ink-jet head 30 used for the printing under the same or equivalent condition (condition including, for example, the size, the material quality, and the fixing method). The Lanczos method is used for the method for calculating the characteristic value. Accordingly, the following result was obtained. That is, the primary mode frequency is 11.3 kHz, the secondary mode frequency is 27.5 kHz, and the tertiary mode frequency is 43.6 kHz. The ink-jet head 30 used for the measurement is provided with the protective frame 92 as well. However, the protective frame 92 is gently joined to the head body 25 by using a soft adhesive. Therefore, the protective frame 92 is not considered when the natural frequency is calculated, assuming that the degree of influence is small with respect to the natural frequency of the ink-jet head 30.

The crosstalk is often caused when the ink discharge is performed by another nozzle immediately after the ink discharge is performed by a certain nozzle. For example, when dots of different colors are formed adjacently on the printed image, the different nozzles perform the ink discharge closely in the time scale, in which the crosstalk tends to arise. Therefore, for example, when a black line is drawn on a background color of yellow, a phenomenon occurs, for example, such that the yellow background color is thinned in the vicinity of the black line as compared with other portions.

As shown in FIG. 8, the crosstalk is conspicuous when the printing frequency is 26 kHz and 28 kHz. Even when the printing frequency is 10 kHz and 12 kHz, the influence of the crosstalk is observed, but the printing quality remains at the practical level. The reason, why the influence by the secondary mode vibration conspicuously appears as described above, is that all of the nozzles are vibrated at the same phase in the primary mode vibration, while the nozzles, which are positioned in the vicinity of the two portions corresponding to the antinodes of the proper vibration in the secondary mode vibration respectively, are vibrated at the antiphase (phase deviation of 180°) in the secondary mode vibration respectively. Therefore, the differences in the velocity and the acceleration between the nozzles, which are brought about by the secondary mode vibration as shown in FIG. 7C, are relatively large. Therefore, when the printing frequency is close to 27.5 kHz as the frequency of the secondary mode, the crosstalk especially and easily arise.

A range, in which the crosstalk is hardly caused, is specified in accordance with the relationship between the printing frequency and the proper vibration, in view of the situation of the occurrence of the crosstalk as shown in FIG. 8. For example, in this embodiment, the printing frequency of the ink-jet head 30 is not more than 30 kHz. Therefore, the printing can be performed at a quality which is approximately not less than the practically usable extent by avoiding 26 to 28 kHz as the frequency zone corresponding to the secondary mode of the proper vibration.

In particular, with reference to FIG. 8, when the printing frequency is not more than 8 kHz and not less than 14 kHz and not more than 22 kHz or not less than 32 kHz, the printing is performed without causing any problem in view of the practical use, Alternatively, when the printing frequency is not more than 6 kHz or not less than 34 kHz, then the crosstalk is hardly caused, or the crosstalk is not caused substantially at all. On the other hand, the secondary mode frequency is 27.5 kHz. Therefore, the range, in which the printing is performed without causing any problem in view of the practical use, is generalized such that a ratio of the secondary mode frequency to printing frequency is not more than 0.85 and not less than 1.25 and not more than 1.96 or not less than 3.44 on the basis of the secondary mode frequency. The range, in which the crosstalk is hardly caused or the crosstalk is not caused substantially at all, is generalized to have a ratio of not more than 0.80 or not less than 4.59 on the basis of the secondary mode frequency as well.

As described above, the crosstalk, which is caused by the secondary mode of the proper vibration, is especially great. Therefore, when the range, in which the crosstalk is hardly caused, is generalized, the secondary mode frequency is used as the basis as described above.

Therefore, in the case of the ink-jet head which is capable of performing the printing under the condition as described above, the crosstalk is hardly caused, and the reproducibility of the printed image is more enhanced. In the case of the head based on the system in which the discharge driving is effected by applying any external force to the head body as in the ink-jet head of this embodiment, the crosstalk is suppressed when the ratio of the secondary mode frequency to the printing frequency is within the range as described above, irrelevant to the difference in the material of the head body and the presence or absence of the member such as the protective frame. In this embodiment, as described above, the reinforcing frame 91 is stuck to the upper surface of the head body 25. The reinforcing frame 91 is stuck by the aid of the brazing filler metal to the ends of the entire surroundings of the upper surface of the head body 25. The reinforcing frame 91 strongly grasps the head body 25 in the inter-nozzle direction connecting the nozzles each belonging to one of the different nozzle rows 58 (support member). Accordingly, the secondary mode frequency of the proper vibration of the ink-jet head is increased as compared with a case in which the ink-jet head has no reinforcing frame. Therefore, when the printing frequency is smaller than the secondary mode frequency and the printing frequency is close to the secondary mode frequency in an ink-jet head which does not have such a reinforcing frame, the difference between the printing frequency and the secondary mode frequency is increased by introducing the reinforcing frame 91 as described above. Accordingly, the resonance is hardly caused in relation to the vibration in the inter-nozzle direction, and the crosstalk is hardly caused. As described above, the reinforcing frame 91 functions as the adjusting member for adjusting the secondary mode frequency.

The nozzle plate 101, which includes the nozzle surface 25*a* of the head body 25, is formed of the metal material in this embodiment (metal member). For example, when the nozzle plate is formed of a material having a low hardness, the printing frequency is smaller than the secondary mode frequency, and the printing frequency is close to the secondary mode frequency, then the difference between the printing frequency and the secondary mode frequency can be increased by changing the material for the nozzle plate to the metal material. Accordingly, the vibration, which relates to the inter-nozzle direction, is hardly caused, and the crosstalk is hardly caused.

Other than the above, it is also assumed that the crosstalk is hardly caused in the ink-jet head 30, for example, when the thickness of the flow passage unit 27 in the stacking direction is large and when the length of the flow passage unit 27 in the short direction is small.

Modification of the Embodiment

The preferred embodiment of the present invention has been explained above. However, the present invention is not limited to the embodiment described above, which may be changed in other various forms within the range defined by the claims.

For example, in the embodiment described above, the nozzle rows 58 are each formed by the plurality of nozzles 28 in the ink-jet head 30. However, even if the nozzle row is not formed, the crosstalk is caused as described above when a plurality of nozzles are formed in the ink-jet head. Therefore, the present invention is also applicable to such a case. It is also allowable that the ink chamber, which extends in the longitudinal direction of the flow passage unit 27 like the common ink chamber 99, is not formed in the flow passage unit 27. In the embodiment described above, the ink-jet head is the serial head for the serial printer. However, it is also allowable to use a line head for a line printer.

In order to decrease the crosstalk by increasing the difference between the printing frequency and the secondary mode frequency, the following conditions are proposed in the embodiment described above. That is, for example, the reinforcing frame 91 and the protective frame 92 are adopted, the metal material is used for the main parts, the thickness of the flow passage unit 27 is increased, and the length of the flow passage unit 27 in the short direction is decreased. However, it is not necessarily indispensable that all of the conditions as described above are satisfied- Even when one of the conditions as described above is adopted, an effect is obtained to decrease the crosstalk.

The liquid droplet-jetting head of the present invention is not limited to the ink-jet head for discharging the ink. The present invention is also applicable to any liquid droplet-jetting head for jetting various liquids other than the ink, including, for example, reagent, biological solution, solution for wiring material, solution for electronic material, cooling medium, and liquid fuel.

What is claimed is:

1. A liquid droplet-jetting head which jets liquid droplets at a predetermined resolution while moving relative to an object, the liquid droplet-jetting head comprising:

a flow passage unit which has a plurality of nozzles for discharging the liquid droplets and a nozzle surface in which the nozzles are formed;

wherein a ratio of a secondary mode frequency of inter-nozzle proper vibration in relation to an inter-nozzle direction along a line connecting a nozzle of the nozzles and another nozzle in the nozzle surface, to a jetting frequency which is a reciprocal of time required for the object to move relative to the liquid droplet-jetting head by a unit distance corresponding to the predetermined resolution, is one of a value of-not more than 0.85, a value in a range of 1.25 to 1.96, and a value of not less than 3.44.

2. The liquid droplet-jetting head according to claim 1, wherein the ratio is 1.25 to 1.96.

3. The liquid droplet-jetting head according to claim 1, wherein the jetting frequency is not more than 30 kHz.

4. The liquid droplet-jetting head according to claim 1, wherein the flow passage unit has a nozzle row which is formed by the nozzles aligned on a line in the nozzle surface.

5. The liquid droplet-jetting head according to claim 1, wherein:

the flow passage unit has a plurality of nozzle rows which are arranged in parallel to each other, and each of the nozzle rows includes the nozzles aligned on a line in the nozzle surface; and the inter-nozzle direction is a direction along a line connecting a nozzle of the nozzles belonging to a nozzle row of the nozzle rows and another nozzle belonging to another nozzle row which is different from the nozzle row.

6. The liquid droplet-jetting head according to claim 1, further comprising an adjusting member which adjusts the ratio.

7. The liquid droplet-jetting head according to claim 1, further comprising a support member which extends in the inter-nozzle direction, wherein the support member is joined to the flow passage unit.

8. The liquid droplet-jetting head according to claim 7, wherein:

a portion of the flow passage unit joined to the support member and the support member are formed of a metal material; and the flow passage unit and the support member are joined to each other with a brazing filler metal.

9. The liquid droplet-jetting head according to claim 1, wherein the flow passage unit includes a metal member which extends in the inter-nozzle direction.

10. The liquid droplet-jetting head according to claim 9, wherein the nozzle surface is formed on the metal member.

11. The liquid droplet-jetting head according to claim 1, wherein the flow passage unit is flat plate-shaped, and the flow passage unit is formed with a plurality of pressure chambers, a liquid chamber which is commonly communicated with the pressure chambers, and a plurality of flow passages each communicating the liquid chamber with one of the pressure chambers and one of the nozzles.

12. The liquid droplet-jetting head according to claim 11, wherein the liquid chamber includes a plurality of common liquid chambers, and each of the common liquid chambers extends in a direction which is parallel to the nozzle surface and which is perpendicular to the inter-nozzle direction.

13. The liquid droplet-jetting head according to claim 11, further comprising an actuator which applies a pressure to the pressure chambers, wherein the actuator is stacked on a surface of the flow passage unit on a side opposite to the nozzle surface.

14. The liquid droplet-jetting head according to claim 13, wherein the actuator applies an external force to the flow passage unit.

15. A liquid-jetting apparatus which jets a liquid to an object, the liquid-jetting apparatus comprising:

a moving mechanism which moves the object in a predetermined direction; and a head which jets the liquid at a predetermined resolution while moving relative to the object, and which includes: a flow passage unit which has a plurality of nozzles for discharging liquid-droplets of the liquid, a plurality of pressure chambers communicated with the nozzles, and a nozzle surface having the nozzles formed therein; and an actuator unit which is formed in the flow passage on a side opposite to the nozzle surface so as to face the pressure chambers, and which applies a pressure to the pressure chambers, wherein:

a ratio of a secondary mode frequency of inter-nozzle proper vibration in relation to an inter-nozzle direction along a line connecting a nozzle of the nozzles and another nozzle in the nozzle surface, to a frequency which is a reciprocal of time required for the object to move relative to the head by a unit distance corresponding to the predetermined resolution, is one of a value of not more than 0.85, a value in a range of 1.25 to 1.96, and a value of not less than 3.44.

16. The liquid-jetting apparatus according to claim 15, wherein the liquid-jetting apparatus is an ink-jet printer.

17. The liquid-jetting apparatus according to claim 15, wherein the head further includes an adjusting member which adjusts the ratio.

18. The liquid-jetting apparatus according to claim 17, wherein the adjusting member is a support member which extends in the inter-nozzle direction, and the support member and the flow passage unit are joined to each other.

19. A liquid droplet-jetting method for jetting liquid droplets by using a liquid droplet-jetting head which jets the liquid droplets at a predetermined resolution while moving relative to an object, the liquid droplet-jetting method comprising:

preparing the liquid droplet-jetting head provided with a flow passage unit which has a plurality of nozzles for discharging the liquid droplets and a nozzle surface in which the nozzles are formed; and determining a jetting frequency so that a ratio of a secondary mode frequency of inter-nozzle proper vibration in relation to an inter-nozzle direction along a line connecting a nozzle of the nozzles and another nozzle in the nozzle surface, to the jetting frequency which is a reciprocal of time required for the object to move relative to the liquid droplet-jetting head by a unit distance corresponding to the predetermined resolution, is one of a value of not more than 0.85, a value in a range of 1.25 to 1.96, and a value of not less than 3.44.

* * * * *